United States Patent [19]

Lennon

[11] 4,082,412

[45] Apr. 4, 1978

[54] MALE AND FEMALE TERMINAL COMBINATION

[75] Inventor: David C. Lennon, Morrison, Ill.

[73] Assignee: General Electric Company, Fort Wayne, Ind.

[21] Appl. No.: 645,043

[22] Filed: Dec. 29, 1975

[51] Int. Cl.[2] ..... H01R 13/12

[52] U.S. Cl. ..... 339/256 SP

[58] Field of Search ..... 339/95, 191–194, 339/252, 253, 256, 258, 223

[56] References Cited

U.S. PATENT DOCUMENTS

| | | | |
|---|---|---|---|
| 1,799,346 | 4/1931 | Apple | 339/192 T |
| 2,648,827 | 8/1953 | Knollman | 339/256 |
| 2,760,173 | 8/1956 | Cunningham | 339/76 |
| 3,341,805 | 9/1967 | De Vito | 339/111 |
| 3,404,368 | 10/1968 | Roberts et al. | 339/223 |
| 3,577,118 | 5/1971 | Reider | 339/258 R |
| 3,790,917 | 2/1974 | Ray | 339/95 R |
| 3,850,496 | 11/1974 | Hague | 339/64 M |

FOREIGN PATENT DOCUMENTS

| | | | |
|---|---|---|---|
| 668,290 | 7/1929 | France | 339/193 S |
| 928,507 | 7/1947 | France | 339/256 R |
| 292,321 | 6/1928 | United Kingdom | 339/258 R |
| 370,061 | 4/1932 | United Kingdom | 339/258 R |

*Primary Examiner*—Joseph H. McGlynn
*Attorney, Agent, or Firm*—Joseph E. Papin

[57] ABSTRACT

A female terminal for receiving in electrical contacting engagement a spade portion of a male terminal. The female terminal includes a strip of electrical conductive material having a distal portion integral with another portion. The distal portion comprises a generally cylindric section having a bore therein which extends generally crosswise of the strip for the electrical contacting engagement with the spade portion. An end on the cylindric section includes a beveled surface for abutting engagement with the another portion of the strip.

A method of making a female terminal is also disclosed.

12 Claims, 8 Drawing Figures

MALE AND FEMALE TERMINAL COMBINATION

FIELD OF THE INVENTION

This invention relates generally to electrical connectors of the quick connect or disconnect type and in particular to a female terminal and male terminal combination.

In the past, various types of female terminals have been provided for receiving in electrical contacting engagement male terminals, and the electrical contacting part of such female terminals have been afforded various shapes and various schemes for receiving and releasably retaining in frictional engagement such male terminals. Copending application of Richard A. Wandler, Ser. No. 645,044 filed on Dec. 29, 1975 discloses female terminals and methods of making such.

The past quick connect or quick disconnect female terminals were provided with a generally annular or cylindric section having a bore therein for receiving a male terminal in interference or frictional engagement to effect electrical contacting engagement therebetween. The cylindric section of these past female terminals was split generally lengthwise or longitudinally of the bore thereof. In some of such past female terminals, the split ends of the cylindric section thereof were disposed generally in abutting or end-to-end relation; however, one of the disadvantageous or undesirable features of this particular type of female terminal is believed to be that it was necessary to closely control the tolerances of the bore and a spade type male terminal inserted generally diametrally into the bore in order to prevent displacement opening of the abutted split ends of the cylindric section. Of course, such close tolerance control is believed to have adversely affected costs of making this particular type of female terminal as well as the spade type male terminal therefor. Further, the aforementioned spreading or opening of the abutted split ends is believed to have adversely affected the integrity of the electrical contacting engagement of the male terminal spade if it was diametrally positioned in the bore of the cylindric section generally at the spread or opening between the abutted split ends thereof. In some of these past terminals, reinforcing bands or such similar means were provided about the cylindric sections to prevent the spread or opening of the abutted split ends thereof, but it is believed that the cost involved in this particular scheme resulted in disadvantages which might outweight the end result thereof.

In another of the past female terminals, the split ends of the cylindric section were supported generally against separation by a plurality of bands lanced from the cylindrical section generally opposite the split ends and depressed into the bores of the cylindric section so as to extend generally crosswise over the split ends. These bands were fused in place to the bore of the cylindric section. While these fused bands may have strengthened the cylindrical section to prevent opening of the split ends, it is believed that at least one of the disadvantageous features of this scheme was that it adversely affected the cost of making and was rather complicated for efficient manufacture.

SUMMARY OF THE INVENTION

Among the several objects of the present invention may be noted the provision of an improved male terminal and female terminal combination which overcome the disadvantageous or undesirable features discussed hereinabove, as well as others, with respect to the prior art; the provision of such female terminal and male terminal combination which inherently opposes deleterious opening of a cylindric section defining a bore in the female terminal for receiving in electrical contacting engagement the male terminal; the provision of such female terminal and male terminal combination which insures constant electrical contact with such male terminal; the provision of such female terminal and male terminal combination in which a bore is provided in the female terminal having a generally uninterrupted circumferential section for effecting constant electrical contacting engagement with the male terminal inserted thereinto; and the provision of such female terminal and male terminal combination which are simplified in design and economically and easily manufactured. These as well as other objects and advantageous features of the present invention will be in part apparent and in part pointed out hereinafter. In general and in one form of the invention, a female terminal for receiving in electrical contacting engagement a male terminal includes a strip of electrical conductive material having a distal portion integral with another portion. The distal portion constitutes a generally cylindric section having a bore therein extending generally crosswise of the strip for the electrical contacting engagement with the male terminal, and an end on the cylindric section includes a beveled surface for abutting engagement with the other portion.

The present invention also includes in general and in one form thereof another method of making a female terminal from a generally thin strip of electrical conductive material comprising the steps of: forming a beveled end having a free edge on a distal portion of the strip; deforming the distal portion into a generally cylindric section to define a bore therein; and abutting the beveled end with another portion of the strip adjacent the distal portion so as to generally blend the free edge with the bore and provide at least as part of the bore with a generally uninterrupted circumference.

BRIEF DESCRIPTION OF THE DRAWINGS

Corresponding reference characters indicate corresponding parts throughout the several views of the drawings.

The exemplifications set out herein illustrate the preferred embodiments of the invention in one form thereof, and such exemplifications are not to be contrued as limiting the scope of the invention in any manner.

DETAILED DESCRIPTION OF THE PREFERRED EMBODIMENTS

Figure 1:
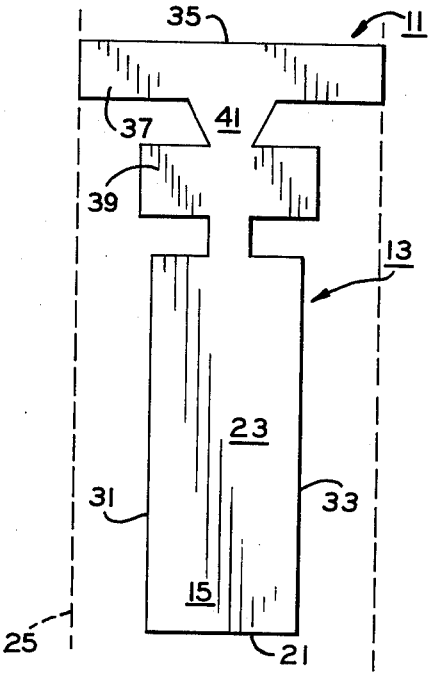
FIG. 1 is a plan view of a female terminal in an early stage of its manufacture blanked from a strip of electrical conductive material and teaching at least in part principles of a method of making such female terminal.
Figure 2:
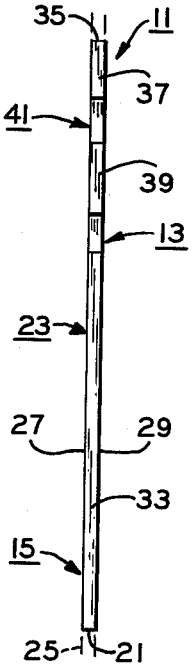
FIG. 2 is a side elevational view of the female terminal of FIG. 1.
Figure 3:
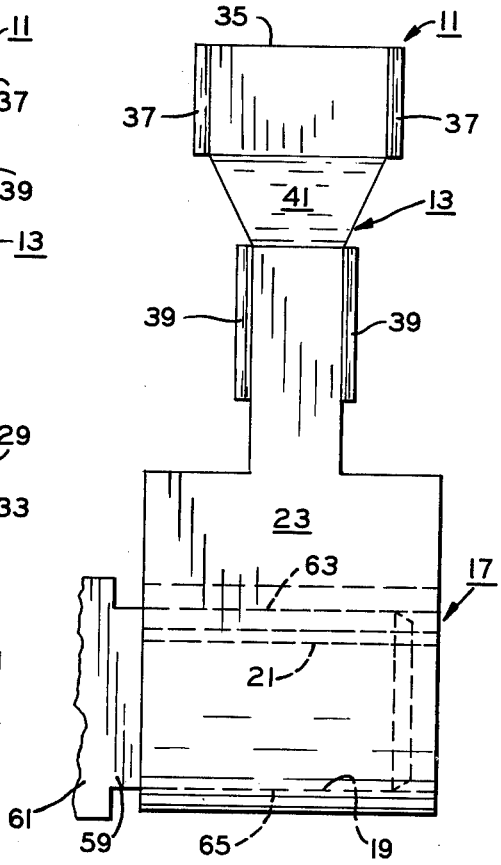
FIGS. 3 and 4 are enlarged plan and side views illustrating the female terminal in its completed stage of manufacture and further teaching principles of the aforementioned method of making such female terminal.
Figure 4:
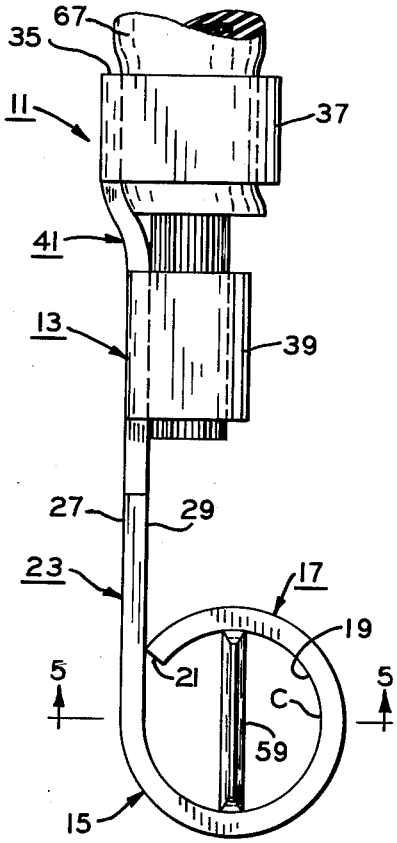
Figure 5:
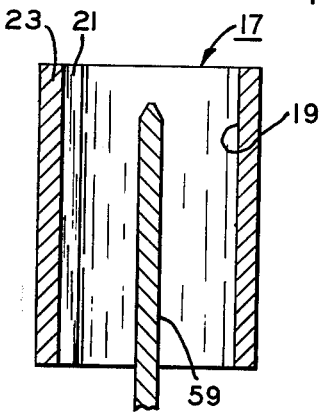
FIG. 5 is a sectional view taken generally along line 5—5 of FIG. 4.

Referring now to FIGS. 1-5 in general, there is illustrated a method of making or manufacturing a quick connect (or disconnect) electrical female terminal 11 of a generally thin strip or body 13 of electrical conductive material (FIGS. 1 and 2). In this method, a distal portion 15 of strip 13 is deformed into a generally annular or cylindric section 17 having a bore 19 extending therethrough generally crosswise of the strip, and at least a portion of a free end 21 on the cylindric section is disposed at least closely adjacent another portion 23 of the strip integral with the distal portion for abutting engagement with the other portion (FIGS. 3-5 ).

More particularly and with specific reference to FIGS. 1 and 2, strip or female terminal body 13 may be stamped, punched or otherwise formed from a continuous electrical conductive strip material, as indicated in phantom lines at 25, in any manner well known to the art, such as for instance by the use of progressive dies, but for the sake of brevity and simplicity of disclosure, such progressive dies are omitted. Strip 13 is generally thin and planar having a pair of opposite faces 27, 29 intersecting between a pair of opposite sides 31, 33, and another free end 35 is provided on the strip opposite free end 21 thereof with such free ends 21, 35 intersecting between the opposite faces and the opposite sides. During a blanking step or operation of the aforementioned making method, opposite ends or end portions 21, 35 and opposite sides 31, 33 may be blanked out, formed or punched generally simultaneously so as to form oppositely extending, stepped pairs of lead connection arms 37, 39 generally in another or upper distal portion 41 of strip 13.

During the deforming step or operation of the aforementioned making method, lower distal portion 15 of strip 13 is rolled, bent or otherwise deformed generally back upon or over opposite face 29 into cylindric section 17 so as to provide it with a preselected curvature C, and the cylindric section is disposed at least in part in laterally spaced and overlaying relation with intermediate portion 23 of the strip. Upon such deformation of cylindric section 17, end 21 of strip 13 is moved into a position at least closely adjacent opposite face 29 generally at intermediate portion 23 of the strip and extends therealong between opposite sides 31, 33, with at least a portion of the end, such as a corner thereof for instance, disposed for abutting engagement with the opposite face on the intermediate portion of the strip. With cylindric section 13 so formed, it may be noted that opposite face 29 of strip 19 defines at least in part bore 19 within the cylindric section extending between opposite sides 31, 33. At any time during the formation of strip 13, lead connecting arms may be folded from their blanked out, generally planar form, as seen in FIGS. 1 and 2, to a position extending generally perpendicular to upper distal portion 41 of strip 13, as seen in FIGS. 3 and 4.

Figure 6:
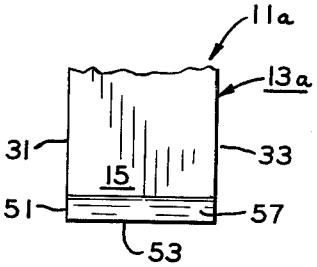
FIG. 6 is a partial plan view of an alternative female terminal in one form of the invention in an early stage of its manufacture blanked from a strip of electrical conductive material and teaching at least in part principles of an alternative method of making such female terminals in one form of the invention.
Figure 7:
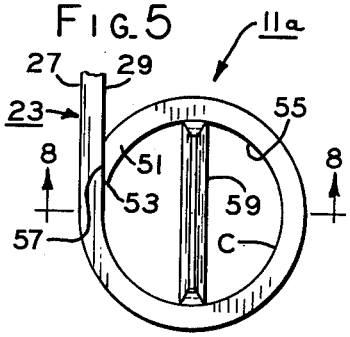
FIG. 7 is an enlarged, partial side elevational view illustrating the alternative female terminal in its completed stage of manufacture and further teaching principles of the aforementioned alternative method of making such alternative female terminal.
Figure 8:
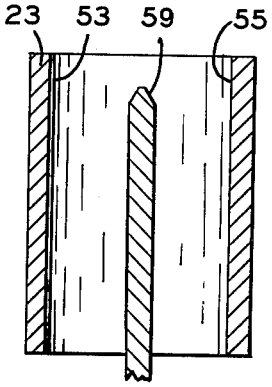
FIG. 8 is a sectional view taken generally along line 8—8 of FIG. 7.

With reference to FIGS. 6-8, there is also illustrated in one form of the invention an alternative method of making or manufacturing an alternative quick connect (or disconnect) electrical female terminal **11*a* also in one form of the invention. Female terminal 11*a* has generally the same component parts as female terminal 11 and the alternative making methods for terminal 11*a* has generally the same steps as the above discussed making method for terminal 11 with the exceptions set out hereinafter. While the alternative making method and female terminal 11*a* meet at least some of the objects and advantageous features set out hereinbefore with respect to the above-discussed making method and terminal 11, it may be noted that the alternative making method and female terminal 11*a*** also meet other objects and have additional advantageous features of their own as will be in part apparent and in part pointed out hereinafter.

In general and recapitulating at least in part with respect to the foregoing discussion, there is shown in FIGS. 6-8 the alternative method in one form of the invention for making female terminal **11*a* of a generally thin strip 13*a* of electrical conductive material. In this method, a beveled end 51 having a free edge 53 is formed on distal portion 15 of strip 13*a*, and the distal portion is deformed into generally cylindric section 17 to define a bore 55 therein. Beveled end 51 is generally abutted with another or intermediate portion 23 of strip 13*a* adjacent distal portion 15 so as to generally blend free edge 53 with bore 55** and provide at least a part of the bore with a generally uninterrupted circumference.

More particularly and with specific reference to FIG. 6., only distal portion 15 of strip **13*a* is shown in its blanked out form since strip 13*a* includes all of the integral parts of strip 13 (as seen in FIGS. 1 and 2) with the singular exception that beveled end 51 having end edge 53 are provided on strip 13*a* in place of end 21 of strip 13. Of course, beveled end 51 and end edge 53 may be formed on strip 13*a* during the blanking or forming step or operation discussed hereinabove with respect to strip 13, and a beveled surface 57 is formed on beveled end 51 so as to generally intersect between opposite faces 27, 29 of strip 13*a***.

During a deforming step or operation of the alternative making method, lower distal portion 15 of strip **13*a* is rolled, bent or otherwise deformed generally back upon or over opposite face 29 into cylindric section 17 so as to provide it with the preselected or predetermined curvature C, and the cylindric section is disposed at least in part in laterally spaced and overlaying relation with intermediate portion 23 of the strip, as best seen in FIG. 7. Upon such deformation of cylindric section 17, beveled end 51 is moved into a position so that beveled surface 57 is disposed at least closely adjacent opposite face 29 generally at intermediate portion 23 for abutting engagement therewith, and end edge 53 of the beveled end is disposed in position with respect to the opposite face defining bore 55 within cylindric section so that curvature C of the bore on opposite sides of the end edge is generally blended together so as to provide a generally continuous or uninterrupted circumferential section of the bore between opposite sides 31, 33 of strip 13*a*. In other words, beveled surface 57 abuts intermediate portion 23 in such a manner, that the curvature of bore 55 generally across end edge 53 is generally constant and the bore is generally continuous. It is contemplated that due to manufacturing tolerances or the like there may be a small gap or flat in bore 55 generally at the juncture of end edge 53 with opposite face 29 within the bore, but it is believed that such gap or flat will not adversely affect the integrity or continuousness of electrical contacting engagement of a spade portion 59 on a male terminal 61** adapted to be inserted into frictional and electrical contacting engagement at various or any diametral positions across the bore, as discussed hereinafter.

Referring again in general to FIGS. 1–5 and recapitulating, at least in part with respect to the above-discussed making method for female terminal 11, the female terminal is adapted for receiving in electrical contacting engagement spade portion 59 having a generally rectangular cross-section of male terminal 61. Female terminal 11 includes strip 13 of electrical conductive material having a generally planar or intermediate portion 23, distal portion 15 integral with the intermediate portion, and free end 21 on the distal portion. Distal portion 15 constitutes generally cylindric section 17 with free end 21 disposed at least closely adjacent intermediate portion 23, and bore 19 within the cylindric section extends generally crosswise of strip 13 for the electrical contacting engagement with spade portion 59.

More particularly, preselected dimensional tolerance relationships between opposite contacts or contact sides 63, 65 of spade portion 59 may be established to provide proper interference fit or frictional engagement thereof with bore 19 of cylindric section 17 so that the spade portion may be releasably retained in the desired electrical contacting engagement therein. Further, due to such tolerance relationship, it is contemplated that the cylindric portion may spring open or enlarge to a calculated degree within tolerance limitations upon the insertion of male terminal spade portion into bore 19 particularly when such engagement is near end 21 so as to effect displacement movement thereof; however, it is believed that the engagement of end 21 on cylindric section 17 with opposite face 29 of intermediate section 23 serves to oppose deleterious displacement movement of free end 21 in response to the insertion of the spade portion into electrical contacting engagement with the bore at least adjacent the free end.

With reference now to FIGS. 6–8 and recapitulating at least in part with respect to the above-discussed making method for female terminal in one form of the invention 11*a*, the female terminal is adapted for receiving in electrical contact male terminal 61, and the female terminal includes strip 13*a* of electrical conductive material having distal portion 15 integral with another portion, such as intermediate portion 23. Distal portion 23 comprises generally cylindric section 17 having bore 55 therein extending generally crosswise of strip 13*a* for the electrical contacting engagement with male terminal 61. End 51 on cylindric section 17 includes beveled surface 57 for abutting engagement with intermediate portion 23.

More particularly, due to preselected dimensional tolerance relationship between spade portion 59 and bore 55, the spade portion may be releasably retained in the desired electrical contacting and frictional engagement in the bore. Further, it is contemplated that cylindric portion 17 may attempt to open slightly or be slightly deformed within the resilient characteristics of the electrical conductive material thereof when spade portion 17 is inserted in any diametral position across bore 55; however, it is believed that the engagement of beveled surface 57 on beveled end 51 of the cylindric section with opposite face 29 of intermediate portion 23 serves to oppose such deformation or deleterious displacement movement of the beveled end in response to the insertion of the spade portion into electrical contacting engagement with bore 55 at least adjacent the beveled end. It may also be noted that end edge 53 of beveled end 51 generally blends with bore 55 wherein the circumference, or at least a circumferential section, thereof is generally uninterrupted so as to effect generally constant electrical contact between the bore and spade portion 59 of male terminal 61 irrespective of any diametral position in which the spade portion may be received across the bore. In other words, curvature C of bore 55 on opposite sides of end edge 53 will be generally constant. As previously mentioned, a gap or flat of generally small proportions may be created in bore 55 due to manufacturing tolerances or the like, but it is believed that the extent of such gap will not affect the electrical contacting or frictional engagement between spade portion 61 and bore 55.

As shown in FIG. 4, an electrical lead 67 may be fixedly received on upper distal portion 41 of strips 13, 13*a* by arms 37, 39; however, it is contemplated that means other than arms 37, 39 for connection in electrical engagement with such lead may be formed with and utilized with female terminals 11, 11*a* within the scope of the invention.

From the foregoing, it is now apparent that novel female terminals 11, 11*a* and novel methods of making such are provided meeting the objects and advantageous features set out herein as well as others, and it is contemplated that changes as to the precise configurations, shapes and details of the structures and also as to the precise steps of the methods, which are presented merely to illustrate the invention, may be made by those having ordinary skill in the art without departing from the spirit and scope of the invention as set out by the claims which follow.

What I claim as new and desire to secure by Letters Patent of the United States is:

1. The combination comprising a spade male terminal, a female terminal for receiving in electrical contacting engagement said spade male terminal in any diametral position thereof, said female terminal including a strip of electrical conductive material having a distal portion integral with another generally planar portion, said distal portion having a generally cylindric section deformed with respect to said another portion so as to be disposed generally laterally thereof and defining at least in part a bore extending generally crosswise of said strip for the electrical contacting engagement with said male terminal, and a free end on said distal portion terminating said strip including a beveled surface predeterminately placed in at least closely adjacent relation with respect to said another portion so that said spade male terminal is received in the any diametral position thereof across said bore in the electrical contacting engagement therewith.

2. A female terminal as set forth in claim 1 wherein said free end further includes an edge generally at the intersection of said beveled surface and said bore so that a portion of said bore integral with said edge and adjacent thereto generally blends with another portion of said bore disposed generally in opposed relation with said edge.

3. The combination as set forth in claim 1 wherein said strip includes a pair of opposite faces at least on said distal portion and said another portion, one of said opposite faces on said distal portion defining at least in part said bore, and said beveled surface being placed in the at least closely adjacent relation with said one opposite face on said another portion.

4. The combination as set forth in claim 3 wherein said beveled surface intersects with said opposite faces, and an edge on said strip generally at the intersection of said beveled surface with said one opposite face wherein a portion of said bore integral with said edge and adjacent thereto generally blends with another portion of said bore disposed generally in opposed relation with said edge.

5. The combination comprising a spade male terminal, a female terminal for receiving in electrical contacting engagement said spade male terminal in any diametral position thereof, said female terminal including a strip of electrical conductive material having a pair of opposite faces, a distal portion on said strip and displaced generally laterally with respect to said strip so as to comprise a generally cylindric section having a predetermined curvature, one of said opposite faces within said cylindric section defining at least in part a bore for the electrical contacting engagement with said spade male terminal, and a beveled surface on said distal portion intersecting with said opposite faces and predeterminately placed at least closely adjacent said one opposite face of said strip on a generally planar part thereof adjacent said distal portion when said distal portion is displaced generally laterally with respect to said strip so that said spade male terminal is received in the any diametral position thereof across said bore in the electrical contacting engagement therewith.

6. The combination as set forth in claim 5 further comprising an edge on said distal portion generally at the intersection of said beveled surface with said one opposite face, the curvature of said one opposite face on opposed sides of said edge generally blending together.

7. The combination as set forth in claim 5 wherein said beveled surface comprises a free end terminating said strip.

8. The combination comprising a male terminal having a spade portion with a pair of diametrally opposite contact sides, a female terminal including a strip of electrical conductive material having a generally planar intermediate portion integrally interposed between a pair of end portions, one of said end portions including means for electrical connection with an electrical lead, the other of said end portions having a generally cylindric section deformed with respect to said intermediate portion so as to extend generally laterally thereof and generally crosswise of said strip, a bore within said cylindric section for electrical contacting engagement with said opposite contact side pair of said male terminal spade portion, and a free beveled end on said strip disposed at least closely adjacent said intermediate portion and having an edge generally blending together adjacent portions of said bore on opposed sides of said edge wherein the circumference about said bore is generally uninterrupted so as to effect generally constant electrical contact between said bore and said opposite contact sides of the male terminal spade portion irrespective of any diametral position in which the male terminal spade portion may be received across said bore.

9. The combination as set forth in claim 8 wherein said strip includes a pair of opposite faces at least on said intermediate portion and said other end portion, one of said end faces within said cylindric section defining at least in part said bore, and said free beveled end intersecting said opposite faces and being disposed at least closely adjacent said one opposite face on said intermediate portion.

10. The combination comprising a spade-type terminal having a pair of opposite contact sides, a female terminal including a strip of electrical conductive material having a distal portion adjacent another portion thereof, said distal portion having a generally cylindric section with a bore therein, and an end surface of said strip on said cylindric section and associated with said another portion of said strip so that a part of said bore adjacent said end surface generally blends with another part of said bore defined by said another portion of said strip and located generally adjacent said end surface thereby to provide a generally constant circumference about said bore for receiving in generally constant electrical contact said opposite contact sides of said spade-type terminal irrespective of any diametral position in which said spade-type terminal may be received across said bore.

11. The combination comprising a spade-type terminal having a pair of opposite contact sides, a female terminal including a strip of electrical conductive material having a distal portion adjacent another portion thereof, said distal portion comprising a generally cylindric section having a bore therein, and a beveled end on said strip disposed at least closely adjacent said another portion so that a portion of said bore adjacent said beveled end generally blends with a portion of said bore defined by said another portion of said strip and so that said bore has a generally constant circumference for receiving in generally constant electrical contact said opposite contact sides of said spade-type terminal irrespective of any diametral position in which said spade-type terminal may be received across said bore.

12. The combination comprising a male terminal having a spade portion, a female terminal for receiving in electrical contacting engagement said spade portion comprising a strip of electrical conductive material having a pair of opposite faces interconnected between a pair of opposite sides, said strip including a generally planar portion, and a distal portion defining a generally cylindric section extending from said planar portion so as to be disposed generally in laterally spaced relation therewith and adjacent one of said opposite faces with said one opposite face defining a bore within said cylindric section, at least one free end on said strip comprising a beveled surface interposed between said opposite faces and said opposite sides with said beveled surface being disposed at least closely adjacent said one opposite face for abutting engagement with said planar portion in opposition to displacement movement of at least a part of said cylindric section upon the insertion of said spade portion of said male terminal diametrally across said bore into the electrical contacting engagement therewith, and an end edge on said strip generally at the intersection of said beveled surface with said one opposite side and extending along said bore generally between said opposite sides of said strip, said end edge being disposed within said bore with respect to said one opposite face wherein portions of said one opposite face on opposed sides of said end edge generally blend together so that the circumference of said bore is generally uninterrupted to insure the electrical contacting engagement between said bore and said spade portion of said male terminal irrespective of any diametral position in which it may be inserted into said bore.

* * * * *

UNITED STATES PATENT AND TRADEMARK OFFICE

CERTIFICATE OF CORRECTION

PATENT NO. : 4,082,412

DATED : April 4, 1978

INVENTOR(S) : David C. Lennon

It is certified that error appears in the above-identified patent and that said Letters Patent are hereby corrected as shown below:

Col. 5, line 43, after "terminal" insert --11a, the female terminal--;
line 44, delete "11a, the female terminal".
Col. 6, line 57, delete "A female terminal" and insert --The combination--.

Signed and Sealed this

*Third* Day of *October 1978*

[SEAL]

*Attest:*

RUTH C. MASON
*Attesting Officer*

DONALD W. BANNER
*Commissioner of Patents and Trademarks*